US005737830A

United States Patent [19]

Yeomans

[11] Patent Number: 5,737,830

[45] Date of Patent: Apr. 14, 1998

[54] APPARATUS FOR TERMINATING ELECTRICAL WIRES

[75] Inventor: Michael Anthony Yeomans, Camp Hill, Pa.

[73] Assignee: The Whitaker Corporation, Wilmington, Del.

[21] Appl. No.: 756,857

[22] Filed: Nov. 26, 1996

[51] Int. Cl.[6] ..... H01R 43/048

[52] U.S. Cl. ..... 29/753; 29/33 M; 29/863; 72/441; 72/712

[58] Field of Search ..... 29/33 M, 753, 29/863; 72/452.3, 452.4, 452.5, 441, 712

[56] References Cited

U.S. PATENT DOCUMENTS

| | | | |
|---|---|---|---|
| 3,861,017 | 1/1975 | Garfinkel et al. | 29/753 X |
| 4,400,873 | 8/1983 | Kindig et al. | 72/441 X |
| 5,491,887 | 2/1996 | Quinn | 29/753 |
| 5,611,141 | 3/1997 | Takada et al. | 29/33 M |

FOREIGN PATENT DOCUMENTS

| | | | |
|---|---|---|---|
| 196243 | 7/1994 | Japan | 29/753 |

*Primary Examiner*—Peter Vo
*Attorney, Agent, or Firm*—Bradley N. Ditty

[57] ABSTRACT

An apparatus (10) is disclosed for holding and actuating a terminal applicator (20) in the attachment of terminals (28) to the ends of electrical wires. The apparatus includes a frame (12) that supports a conventional terminal applicator (20) and a crankshaft (58) journaled in the frame. A crank arm (44, 44') has its lower end (96, 96') eccentrically coupled to the crankshaft and its upper end (104, 104') coupled to the ram (34) of the terminal applicator. A motor (78) rotates the crankshaft, eccentrically moving the lower end (96, 69') of the crank arm, which causes the upper end (104, 104') of the crank arm to move the applicator ram vertically, thereby actuating the terminal applicator (20).

24 Claims, 6 Drawing Sheets

APPARATUS FOR TERMINATING ELECTRICAL WIRES

The present invention relates to apparatus for holding and actuating a terminal applicator in the attachment of terminals to the ends of electrical wires and more particularly to such apparatus having a simplified structure.

BACKGROUND OF THE INVENTION

Terminal applicators are commonly used in the electrical connector industry to attach terminals to electrical conductors. These terminal applicators are operated by means of a press that provides the power to actuate the applicator ram and effect the crimping of the terminal onto the conductor. Such presses include a frame, a ram arranged to undergo reciprocating motion toward and away from a platen, and a power source, such as an electric motor. The terminal applicator is secured to the platen and the ram of the applicator is coupled to and carried by the ram of the press. Typically, the electric motor is run continuously to drive a rotating flywheel which is coupled to a single revolution clutch mechanism that drives a crank coupled to the press ram. When the clutch is tripped the press ram is made to reciprocate one cycle. Such a press is disclosed in U.S. Pat. No. 3,343,398. While this press utilizes a moderately sized electric motor for power, it also requires a rather large and massive flywheel, crank, and clutch mechanism. Another approach is a press for a terminal applicator that utilizes an electric motor that is coupled to a ram crank by means of a drive belt. The press includes a control system that energizes the electric motor only when the ram is to be cycled. At other times the motor drive shaft is stationary. This press, of course, requires a rather large and powerful motor and relatively complex motor controller. Such a motor controller is disclosed in U.S. Pat. No. 5,449,990 which issued Sep. 12, 1995 to Bowling et al. Both of these types of presses require that the press crank and press ram mechanisms be strong and able to accommodate the high forces required to crimp a terminal onto a conductor. As a result, these presses tend to be bulky and massive, and tend to undergo substantial wear during use. Because of the tendency for these presses to be bulky, the host machines that receive them must themselves be larger than would otherwise be necessary.

What is needed is an apparatus for operating a terminal applicator in the attachment of terminals to conductors wherein the apparatus does not have a massive conventional press ram. The apparatus should utilize relatively light actuating components that are inexpensive to manufacture and maintain. Further, the apparatus should be compact for easy adaptation to host machines of relatively small size.

SUMMARY OF THE INVENTION

An apparatus is disclosed for holding and actuating a terminal applicator in the attachment of terminals to the ends of electrical wires. The applicator includes a housing, lower tooling attached to the housing, and a ram slidingly coupled to the housing. The ram carries upper tooling and is arranged to undergo reciprocating motion so that the upper tooling moves toward and into engagement with the lower tooling for effecting the attachment of a terminal, then moving away therefrom. The apparatus has a frame including a base plate and a support housing extending upwardly from the base plate. The frame includes a mounting surface for receiving the terminal applicator. A crank is provided having a crank body journaled for rotation in the support housing. A power unit is attached to the frame and is drivingly coupled to the crank body for rotating the crank. A crank arm is provided having a first end eccentrically coupled to the crank body and a second end drivingly coupled to the ram. The apparatus is arranged so that when the power unit rotates the crank, the crank arm imparts reciprocating motion to the ram.

DESCRIPTION OF THE PREFERRED EMBODIMENT

Figure 1:
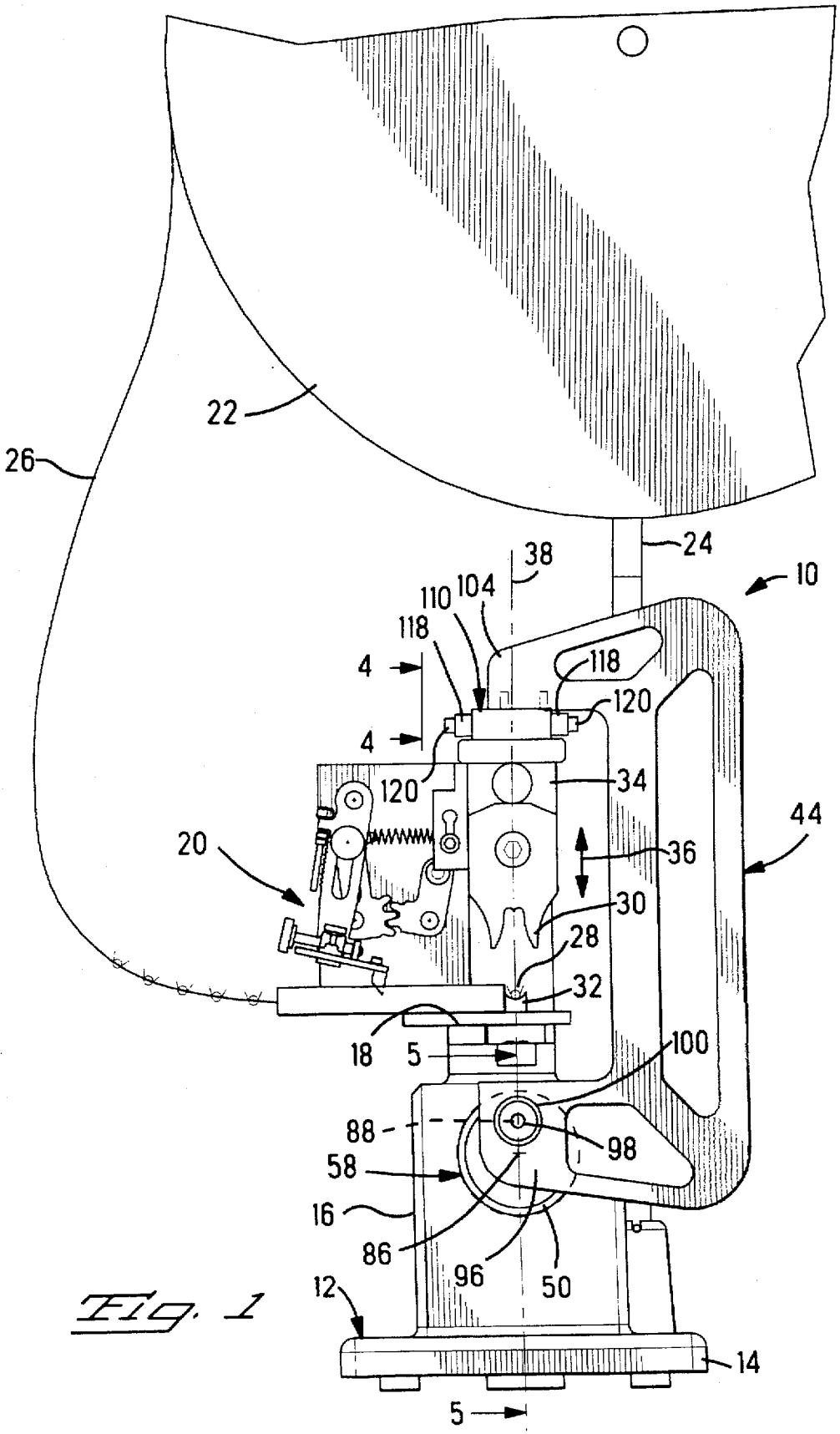
FIG. 1 is a front view of a terminating apparatus incorporating the teachings of the present invention.
Figure 2:
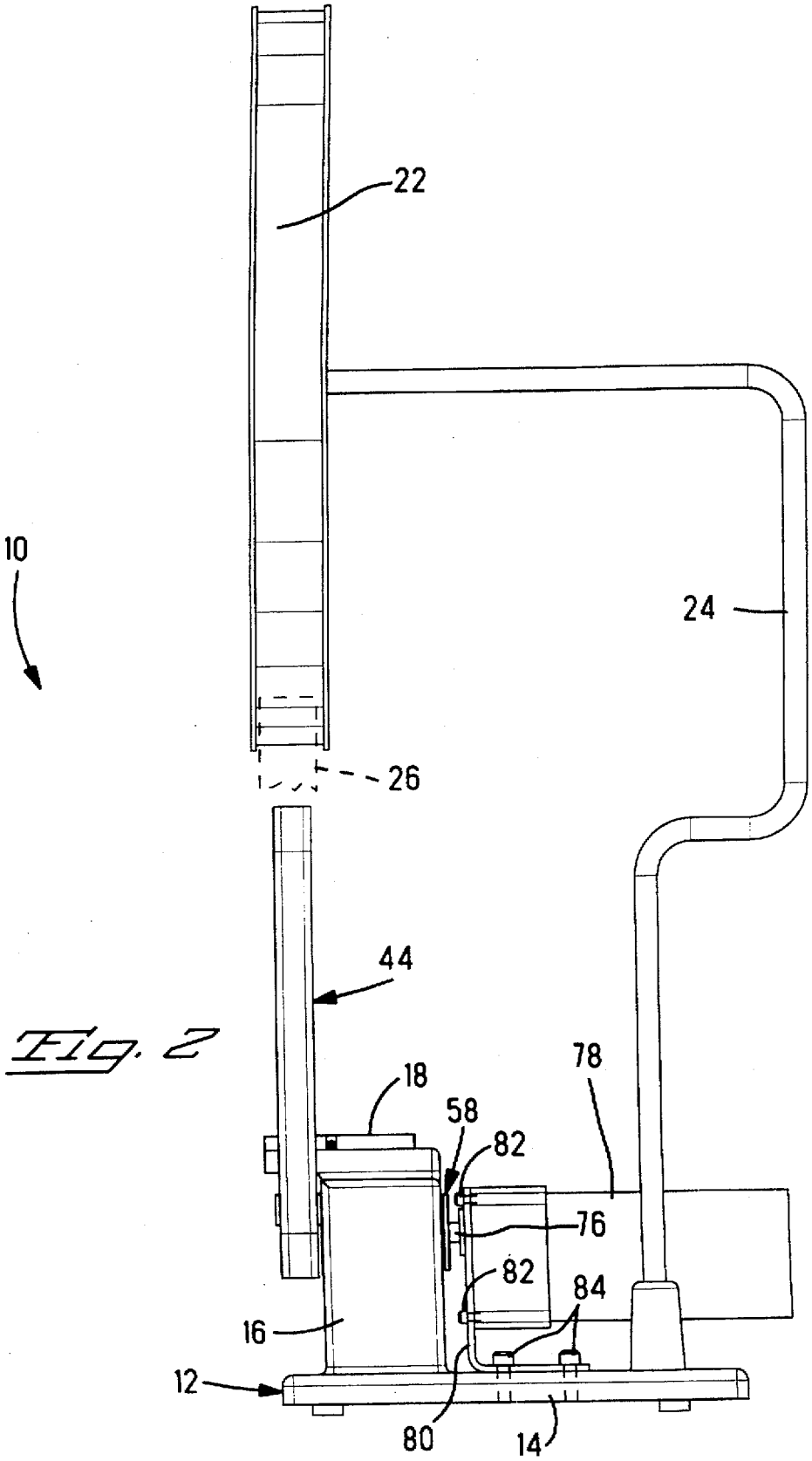
FIG. 2 is a side view of the apparatus shown in FIG. 1 with the applicator removed.
Figure 3:
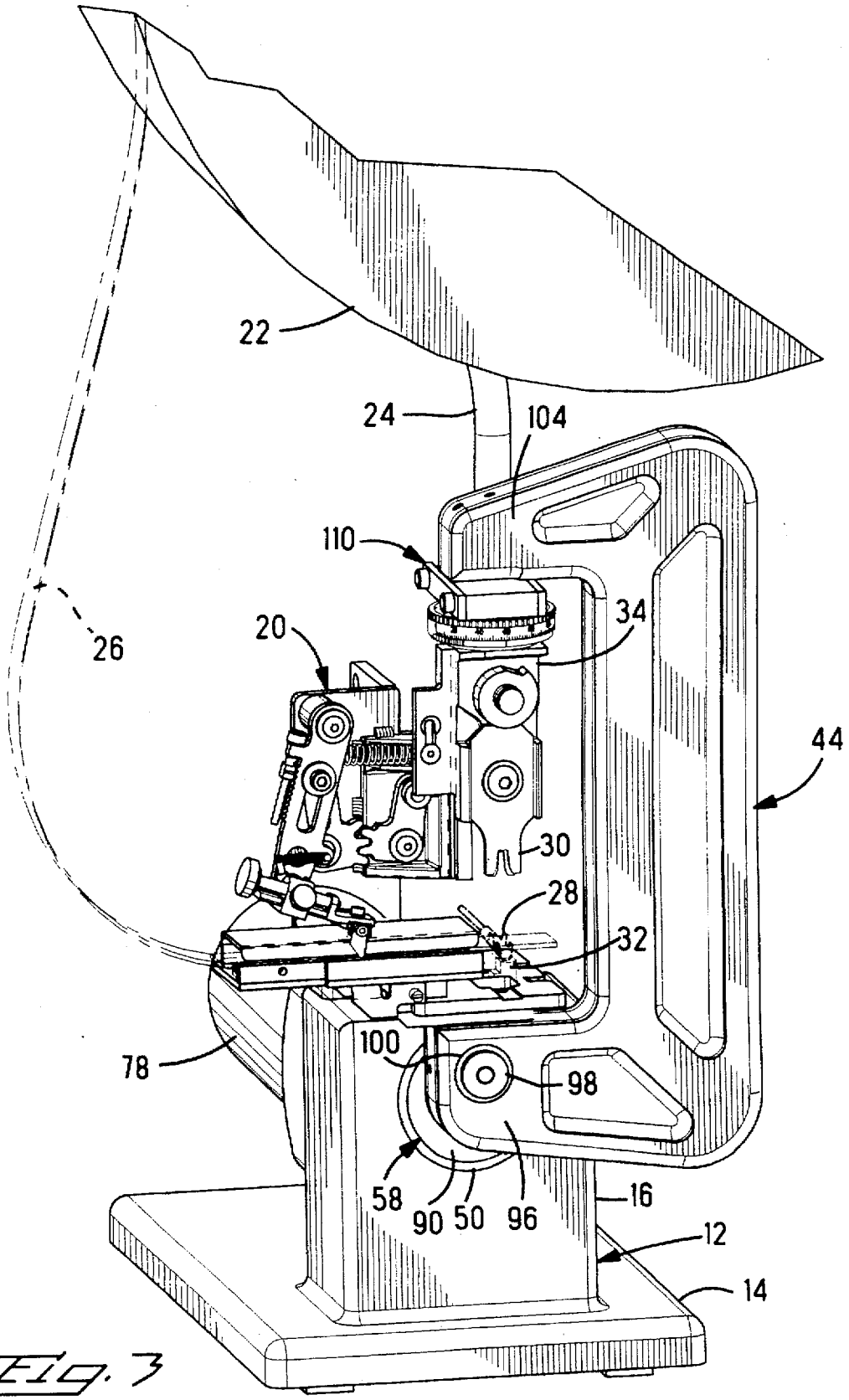
FIG. 3 is an isometric view of the apparatus shown in FIG. 1.

There is shown in FIGS. 1, 2, and 3, a wire terminating apparatus 10 having a frame 12 including a base plate 14 and a housing 16. The housing 16 includes a mounting surface 18 to which a terminal applicator 20 is secured in the usual manner. A reel 22 is journaled for rotation on a support stand 24 that extends upwardly from the base plate 14, and contains a strip 26 of terminals 28 that is fed into the applicator 20 for attachment to the ends of wires, in the usual manner. The applicator includes upper and lower crimping tooling 30 and 32 that cooperate to crimp the terminal 28 onto a wire. The upper tooling 30 is attached to and carried by a reciprocating ram 34 that moves vertically, in the directions of the arrow 36 along a ram axis 38, as viewed in FIG. 1, to bring the upper tooling 30 into crimping engagement with the lower tooling 32. The ram is actuated by a crank arm 44 that will be described in detail below.

Figure 5:
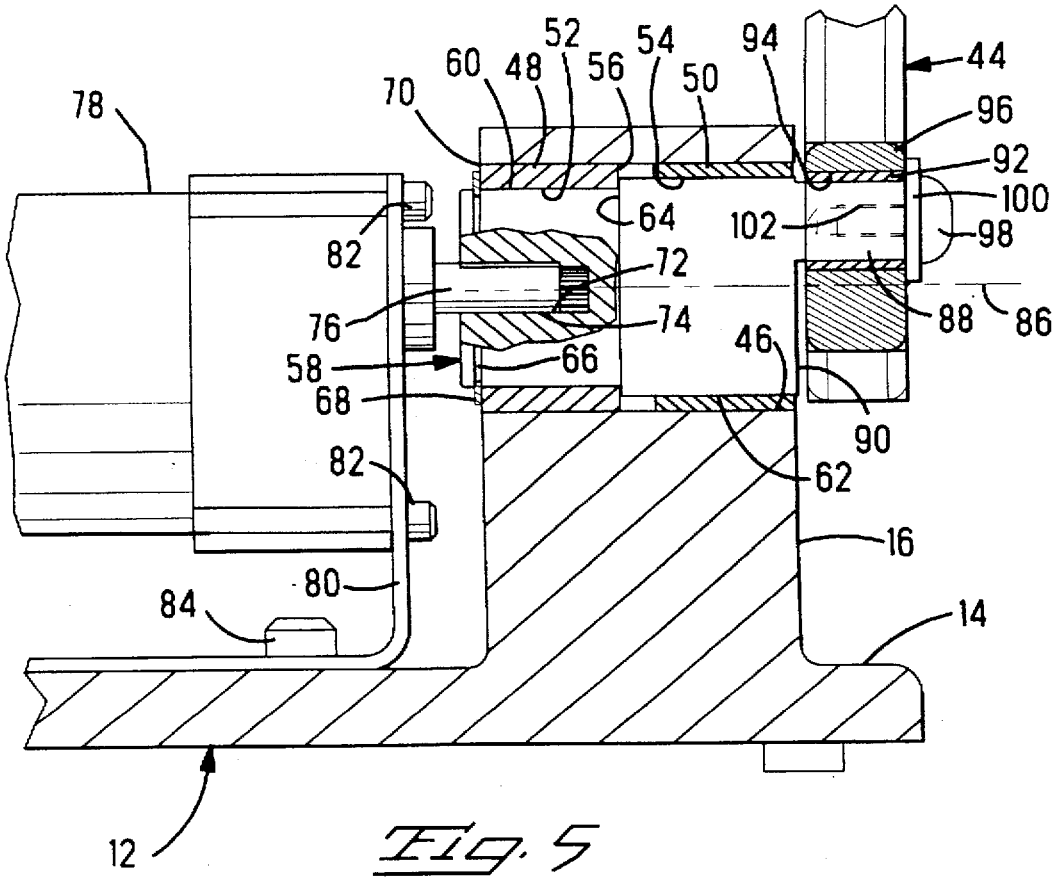
FIG. 5 is a cross-sectional view taken along the lines 5—5 in FIG. 1.
Figure 8:
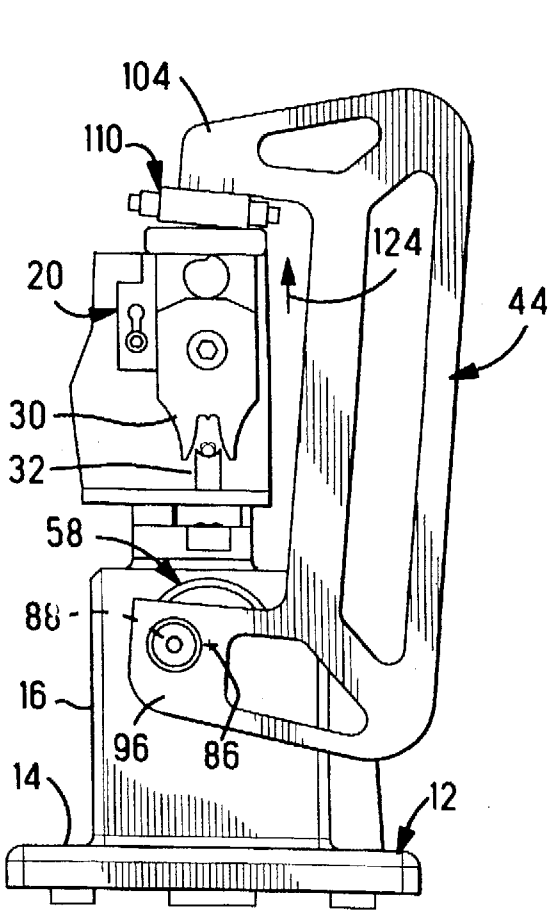
FIGS. 6, 7, and 8 are schematic representations of the apparatus of FIG. 1 shown in various operating positions.

The housing 16 includes a bore 46 that extends completely through the housing parallel to the base plate 14, as shown in FIG. 5. Left and right bushings 48 and 50, respectively, are pressed into the bore 46 so that they are flush with opposite sides of the housing 16 as shown. The left and right bushings 48 and 50 have inside diameters 52 and 54, respectively, wherein the diameter 52 is smaller than the diameter 54, thereby forming a shoulder 56 between the two diameters. A crankshaft 58 is journaled for rotation in the left and right bushings, having left and right outside diameters 60 and 62 that are in rotating engagement with the bushing diameters 52 and 54, respectively. The crankshaft 58 includes a shoulder 64 that is in opposing relationship to the shoulder 56, and a groove 66 formed in the end of the shaft containing an interlocking retaining ring 68 that is in opposing relationship to the flush end 70 of the bushing 48. Therefore, the crankshaft 58 is retained within the housing bore 46 by means of the shoulder 64 and the retaining ring 68 being on opposite sides of the left bushing 48, as shown in FIG. 5. A splined bore 72 is formed in the end of the crankshaft 58 having the groove 66 and is sized to receive a splined shaft 74 that is attached to an output shaft 76 of a gearhead motor 78. The motor 78 is attached to the base plate 14 by means of a bracket 80 and screws 82 that are threaded into holes in the motor and screws 84 that are threaded into holes in the base plate. The outside diameters 60 and 62 and the splined bore 72 are concentric to a common axis 86 that is substantially parallel to the base plate 14.

Figure 4:
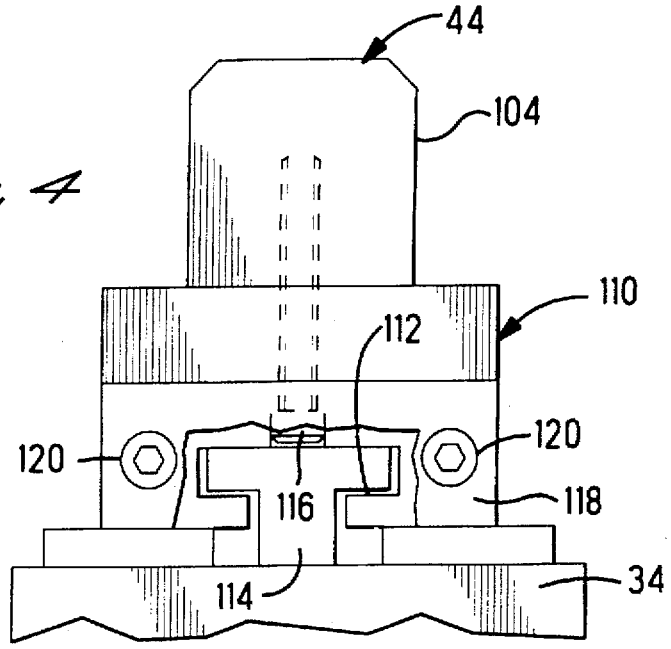
FIG. 4 is a view taken along the lines 4—4 in FIG. 1.

A crank pin 88 extends from an end 90 of the crankshaft 58 and is off-center to the axis 86, as best seen in FIG. 5. A bushing 92 is pressed into a bore 94 formed through a lower end 96 of the crank arm 44 with the crank pin 88 being journaled in the bushing, so that, as the crankshaft 58 rotates, the lower end 96 is made to move eccentrically about the axis 86. A button head screw 98 extends through a washer 100 and into threaded engagement with a hole 102 formed in the end of the crank pin 88 to hold the lower end 96 of the crank arm 44 captive to the crank pin. The crank arm 48 includes an upper end 104 that is opposite the lower end 96, as best seen in FIGS. 1 and 3, and is coupled to the ram 34 of the applicator 20 by means of a coupling 110 shown in FIG. 4. The coupling 110 includes a T-shaped slot 112 that is sized to loosely receive the attachment bolt head 114 that extends from the top of the applicator ram 34. The coupling 110 is secured to the upper end 104 of the crank arm 44 by mens of screws 116 that extend through counterbored holes in the coupling and into threaded holes in the upper end 104. A pair of end plates 118 are attached to opposite sides of the coupling 110 by means of screws 120 to hold the attachment bolt head 114 captive within the T-shaped slot 112. As the crankshaft 58 is rotated by the motor 78, the lower end 96 of the crank arm 44 is made to move eccentrically about the axis 86, thereby causing the upper end 104 to move vertically in the directions indicated by the arrows 36, carrying the ram 34 with it. During this movement the upper end 104 also pivots or rocks slightly first in one direction and then the other direction. There is sufficient vertical and lateral play between the attachment bolt head and the T-shaped slot to accommodate this rocking motion of the upper end 104. The crank arm 44 functions as a two force member in that when the crank pin 88 is nearing its lower most position and the upper and lower tooling are just beginning to engage the terminal 28, the center of the crank pin and the center of the coupling 110 are substantially on or very close to the ram axis 38, so that all of the crimping forces are directed along this axis. This is important because moments are prevented that may urge the ram 34 one way or the other that would cause unnecessary wear of the mechanism.

Figure 7:
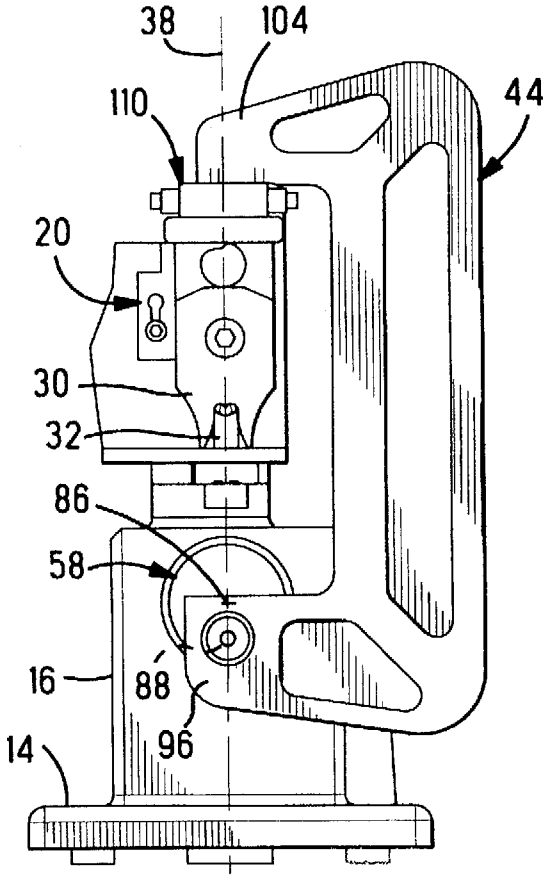
Figure 6:
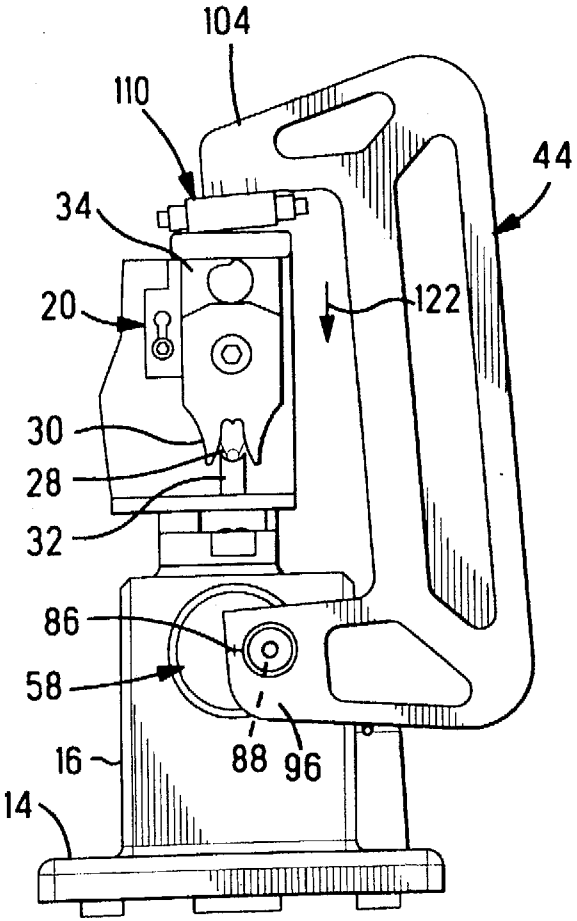

In operation, as best seen in FIGS. 1, 6, 7, and 8, as the crankshaft 58 is rotated clockwise from the starting position, shown in FIG. 1 toward the position shown in FIG. 6, the lower end 96 begins to swing eccentrically about the axis 86 causing the upper end 104 to pivot slightly and move vertically downwardly thereby moving the ram 34 downwardly as indicated by the arrow 122. As the crank pin 88 nears its lowest point, as shown in FIG. 7, the upper and lower tooling 30 and 32 crimpingly engage the terminal 28. At this point, where the crimping force is greatest, the crank arm 44 acts as a two force member since the respective centers of the crank pin 88, crankshaft 58, and coupling 110 are in substantial alignment with the ram axis 38, as shown in FIG. 7. As clockwise rotation of the crankshaft 58 continues, the lower end 96 continues to swing eccentrically about the axis 86 toward the position shown in FIG. 8 causing the upper end 104 to pivot slightly in the opposite direction and move vertically upwardly thereby moving the ram 34 upwardly as indicated by the arrow 124. This motion continues until the crank arm 44 has reached its starting position shown in FIG. 1. This cycle is then repeated any desired number of times.

Figure 9:
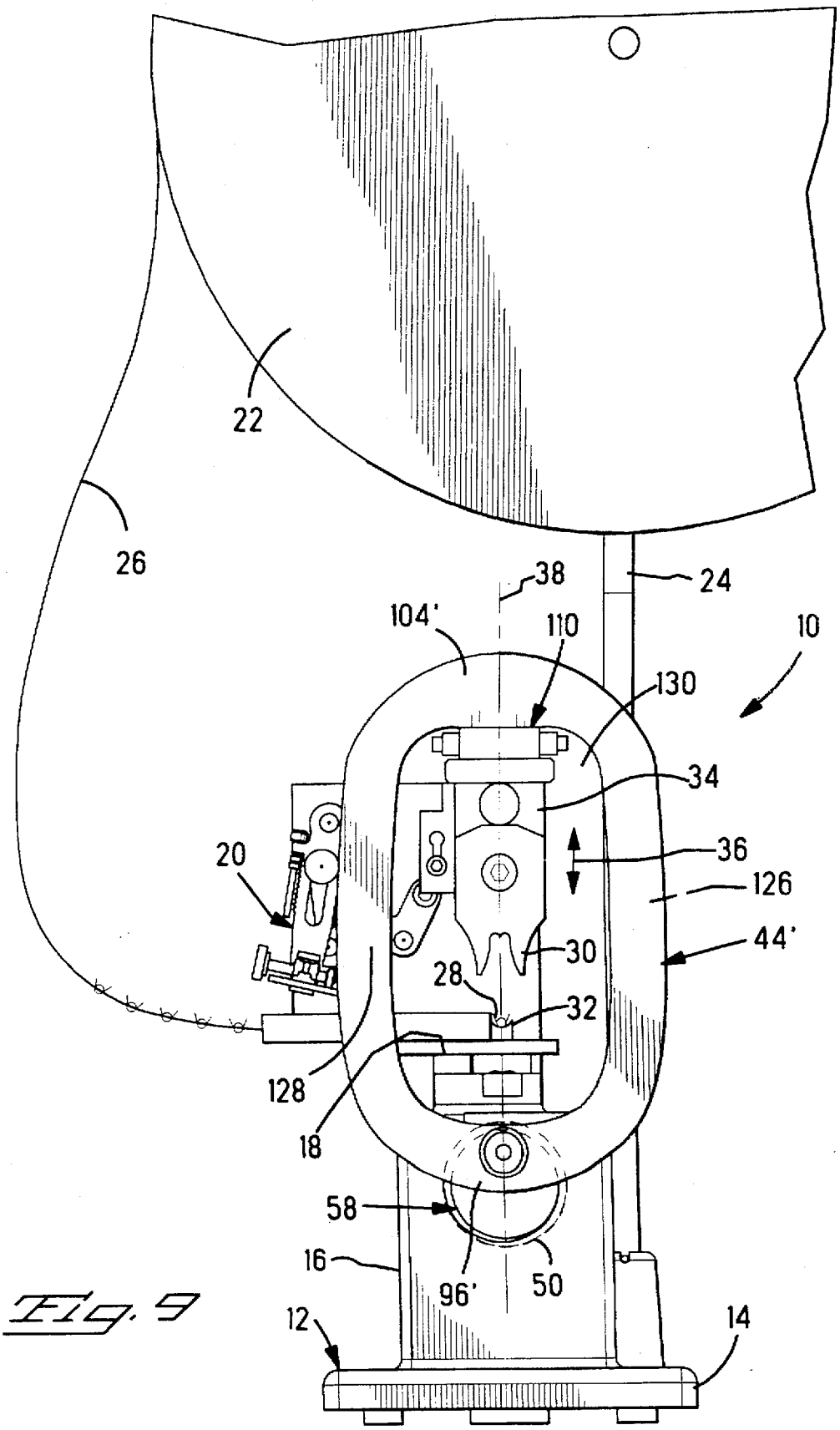
FIG. 9 is a view similar to that of FIG. 1 showing an alternative embodiment of the present invention.

An alternative embodiment of the crank arm 44 is shown in FIG. 9 and identified as 44'. In this embodiment, the crank arm 44' is an arcuate or oval-shaped member having lower and upper ends 96' and 104' and two opposite spaced apart elongated side portions 126 and 128 that interconnect the lower and upper ends. The side portions 126 and 128 and the two ends 96' and 104' form a continuous structure that defines an opening 130. The mounting surface 18 is arranged so that the terminal applicator 20 is positioned so that the ram 34 is within the opening 130 and in vertical alignment with the coupling 110. The crank arm 44' of this embodiment functions in a similar manner to crank arm 44 described above in that as the crankshaft 58 rotates the lower and upper ends 96' and 104' move eccentrically about the crankshaft axis 86 thereby moving the ram 34 vertically along the ram axis 38 from the starting position shown in FIG. 9, through the positions shown in FIGS. 6, 7, and 8.

An important advantage of the present invention is that there is no need for a massive bulky press frame and massive press ram that is characteristic of prior art terminal applicator presses. Further, the present apparatus utilizes relatively light actuating components that are inexpensive to manufacture and maintain. And the apparatus is compact for easy adaptation to host machines of relatively small size.

I claim:

1. Apparatus for holding and actuating a terminal applicator in the attachment of terminals to the ends of electrical wires, wherein said applicator includes a housing, lower tooling attached to said housing, a ram slidingly coupled to said housing and carrying upper tooling, said ram arranged to undergo reciprocating motion so that said upper tooling is moved toward and into engagement with said lower tooling for effecting said attachment and away therefrom, said apparatus comprising:

(1) a frame including a base plate and a support housing extending upwardly from said base plate, said frame including a mounting surface for receiving said terminal applicator;

(2) a crank having a crank body journaled for rotation in said support housing about an axis of rotation;

(3) a power unit attached to said frame and drivingly coupled to said crank body for rotating said crank;

(4) a crank arm having a first end eccentrically coupled to said crank body and a second end drivingly coupled to said ram, wherein said mounting surface is between said first and second ends of said crank arm and said apparatus is arranged so that when said power unit effects said rotation of said crank, said first end of said crank arm moves eccentrically about said axis of rotation and said crank arm imparts said reciprocating motion to said ram.

2. The apparatus according to claim 1 wherein said first end is eccentrically coupled to said crank body by means of a crank pin eccentrically positioned and extending outwardly from an end of said crank body and into driving rotational engagement with said first end of said crank arm.

3. The apparatus according to claim 1 wherein said support housing includes a bore and said crank body has a cylindrical outer surface that is journaled for rotation in said bore.

4. The apparatus according to claim 3 wherein said outer cylindrical surface includes a first diameter and a second smaller diameter forming a shoulder at a junction with said first diameter, said second diameter being journaled in a bearing disposed within said bore of said support housing, said second diameter having a retaining ring coupled to an end thereof and arranged so that said bearing is between said retaining ring and said shoulder.

5. The apparatus according to claim 4 wherein said first diameter is journaled in another bearing disposed within said support housing adjacent said crank arm.

6. The apparatus according to claim 1 wherein said power unit includes an output armature drivingly coupled to said crank body by means of a splined shaft attached to said armature in engagement with a conformal opening formed in said crank body.

7. The apparatus according to claim 1 wherein said crank arm includes an elongated portion wherein said first and second ends extend laterally outwardly from opposite ends thereof so that said first and second ends are mutually opposed.

8. The apparatus according to claim 1 wherein said crank arm includes two spaced apart elongated portions interconnecting said first and second ends and arranged to form an opening therebetween that is adapted to receive at least a portion of said terminal applicator.

9. The apparatus according to claim 1 wherein said second end is drivingly coupled to said ram by means of a coupling attached to said second end, said coupling having a T-shaped slot formed therein that receives a T-shaped head of a post extending from said ram and including caps attached to opposite ends of said coupling to hold said T-shaped head captive within said T-shaped slot.

10. The apparatus according to claim 1 wherein said axis of rotation is substantially perpendicular to said reciprocating motion of said ram.

11. The apparatus according to claim 1 wherein said power unit is an electric motor.

12. Apparatus for causing the ram of a terminal applicator to undergo reciprocating motion in the attachment of terminals to the ends of electrical wires comprising:

(1) a frame having a mounting surface for receiving and supporting said terminal applicator;

(2) a crank having a crank body journaled for rotation in said frame about an axis of rotation;

(3) a power unit attached to said frame and drivingly coupled to said crank body for rotating said crank;

(4) a crank arm having a first end eccentrically coupled to said crank body and a second end drivingly coupled to said ram, wherein said mounting surface is between said first and second ends of said crank arm and said apparatus is arranged so that when said power unit effects said rotation of said crank, said first end of said crank arm moves eccentrically about said axis of rotation and said crank arm imparts said reciprocating motion to said ram.

13. The apparatus according to claim 12 wherein said first end is eccentrically coupled to said crank body by means of a crank pin eccentrically positioned and extending outwardly from an end of said crank body and into driving rotational engagement with said first end of said crank arm.

14. The apparatus according to claim 12 wherein said frame includes a bore and said crank body has a cylindrical outer surface that is journaled for rotation in said bore.

15. The apparatus according to claim 14 wherein said outer cylindrical surface includes a first diameter and a second smaller diameter forming a shoulder at a junction with said first diameter, said second diameter being journaled in a bearing disposed within said bore of said frame, said second diameter having a retaining ring coupled to an end thereof and arranged so that said bearing is between said retaining ring and said shoulder.

16. The apparatus according to claim 15 wherein said first diameter is journaled in another bearing disposed within said bore of said frame adjacent said crank arm.

17. The apparatus according to claim 12 wherein said power unit includes an output armature drivingly coupled to said crank body by means of a splined shaft attached to said armature in engagement with a conformal opening formed in said crank body.

18. The apparatus according to claim 12 wherein said crank arm includes an elongated portion wherein said first and second ends extend laterally outwardly from opposite ends thereof so that said first and second ends are mutually opposed.

19. The apparatus according to claim 12 wherein said crank arm includes two spaced apart elongated portions interconnecting said first and second ends and arranged to form an opening therebetween that is adapted to receive at least a portion of said terminal applicator.

20. The apparatus according to claim 12 wherein said second end is drivingly coupled to said ram by means of a coupling attached to said second end, said coupling having a T-shaped slot formed therein that receives a T-shaped head of a post extending from said ram and including caps attached to opposite ends of said coupling to hold said T-shaped head captive within said T-shaped slot.

21. The apparatus according to claim 12 wherein said axis of rotation is substantially perpendicular to said reciprocating motion of said ram.

22. The apparatus according to claim 12 wherein said power unit is an electric motor.

23. Apparatus for causing the ram of a terminal applicator to undergo reciprocating motion in the attachment of terminals to the ends of electrical wires comprising:

(1) a frame having a mounting surface for receiving and supporting said terminal applicator;

(2) a power unit attached to said frame having a rotating output shaft arranged to rotate about an axis of rotation;

(3) a crank arm having a first end eccentrically coupled to said rotating output shaft and a second end drivingly coupled to said ram, wherein said mounting surface is between said first and second ends of said crank arm and said apparatus is arranged so that when said power unit effects said rotation of said output shaft, said first end of said crank arm moves eccentrically about said axis of rotation and said crank arm imparts said reciprocating motion to said ram.

24. The apparatus according to claim 23 including a crank having a crank body journaled for rotation in said frame, wherein said output shaft is drivingly coupled to said crank body for rotating said crank, and said first end of said crank arm is eccentrically coupled to said crank body.

* * * * *